United States Patent [19]

Magnotto

[11] Patent Number: 4,953,736

[45] Date of Patent: Sep. 4, 1990

[54] PAINT SPLATTER BOX

[76] Inventor: Frank Magnotto, 5203 Kipling St., Springfield, Va. 22151

[21] Appl. No.: 462,025

[22] Filed: Jan. 8, 1990

[51] Int. Cl.[5] ..... B65D 85/00

[52] U.S. Cl. ..... 220/20; 220/90

[58] Field of Search ..... 220/1 C, 20, 83, 90

[56] References Cited

U.S. PATENT DOCUMENTS

| | | | |
|---|---|---|---|
| Re. 27,449 | 8/1972 | Bartz | 220/20 X |
| 768,364 | 8/1904 | Hines | 220/20 |
| 1,008,856 | 11/1911 | Mosher | 220/90 X |
| 2,646,808 | 7/1953 | Yenne | 220/20 X |
| 2,784,434 | 3/1957 | Little | 220/20 X |
| 3,252,613 | 5/1966 | McGrath | 220/90 |
| 3,671,992 | 6/1972 | Linger | 220/90 X |
| 4,061,242 | 12/1977 | Donlon | 220/20 X |
| 4,771,501 | 9/1988 | Leiter | 220/90 X |

*Primary Examiner*—Steven M. Pollard

*Attorney, Agent, or Firm*—Eric P. Schellin

[57] ABSTRACT

There is disclosed a splatter box for paint including a back drop having an abutment for slapping a solvent loaded brush thereagainst. The box also includes compartments for solvent. A paper towel roll rack is also provided. A convenient bail handle is supplied to carry the box and to hook it onto a support.

7 Claims, 2 Drawing Sheets

PAINT SPLATTER BOX

BACKGROUND OF THE INVENTION

It is well known that artists who paint on canvas or the like do so in a great variety of colors and therefore employ brushes of various widths. They also are faced with having to switch their brushes many times as they progress with a painting. As a result at the end of a painting session they are faced with considerable clean up problems as they cannot leave their brushes in a wet state as the paint will harden and the brush will become useless.

Therefore, artists must laboriously go through the stages of cleaning their brushes by dipping and swirling them in small vessels of a solvent, then expressing the solvent laden brush and then as a final step to remove the last vestiges of solvent, strike the bristle portion of the brush against a hard surface thereby releasing droplets of solvent in a shower. The droplets so released will fall or fly in any uncontrolled direction and if in a free environment will mess up with droplets the first object in its path.

PRIOR ART

U.S. Pat. Nos. 3,671,992 and 3,776,371 make an attempt to solve the problem of cleaning artist's brushes by providing receptacles having areas for containing a solvent liquid into which a brush may be dipped and swirled. Both provide means from which a gross amount of the solvent liquid may be removed from the brush. But they do not provide for a splatter surface whereby the last residual drops of solvent may be removed and the drops from such action cannot be recaptured and safely returned to the solvent containing vessel.

U.S.Pat. No. 259,441 is cited to show a combined artist's case and easel where a side drawer is mounted.

U.S. Pat. No. 3,252,174 is cited to show a rounded splatter receiving surface.

U.S. Pat. No. 3,252,613 is cited to show a paint box wherein paint is carried which may be hooked onto a ladder.

None of these references are deemed to anticipate the ingenious present invention as will be described in detail hereinafter.

SUMMARY OF THE INVENTION

The present invention accomplishes the object by a box having an open facing front with side walls, a bottom and a sloping back wall. The sloping back wall is interrupted by a forwardly extending vertical rounded member against which a solvent ladened brush may be struck to and fro in a horizontal motion to thereby unload the residue of solvent from the brush. The droplets of solvent emanating therefrom are suitably captured by the sloping wall and the side walls. The box is also fitted with compartmented wells in which solvents may be located. One well will contain one solvent and the other will contain the same or different solvent. The sloping wall terminates downwardly in a collection area for excess liquid and is provided with an opening through which the accumulated solvent may drain into one or more of the solvent containing compartments.

The box also has a forwardly extending portion to which a paper towel role may be journaled.

A removable and insertable back lid is supplied which functions to close the backside and thereby covers access to compartments in the box and in the other use acts as a easel member extending upwardly of the box.

A bail handle is affixed to the box at the sidewalls thereof for carrying purposes and for attachment to a hook on an upright to locate the box when no flat horizontal supporting surface is available.

BRIEF DESCRIPTION OF THE DRAWINGS

FIG. 3 is a front view of the painter's brush box.

DETAILED DESCRIPTION OF THE INVENTION

Figure 1:
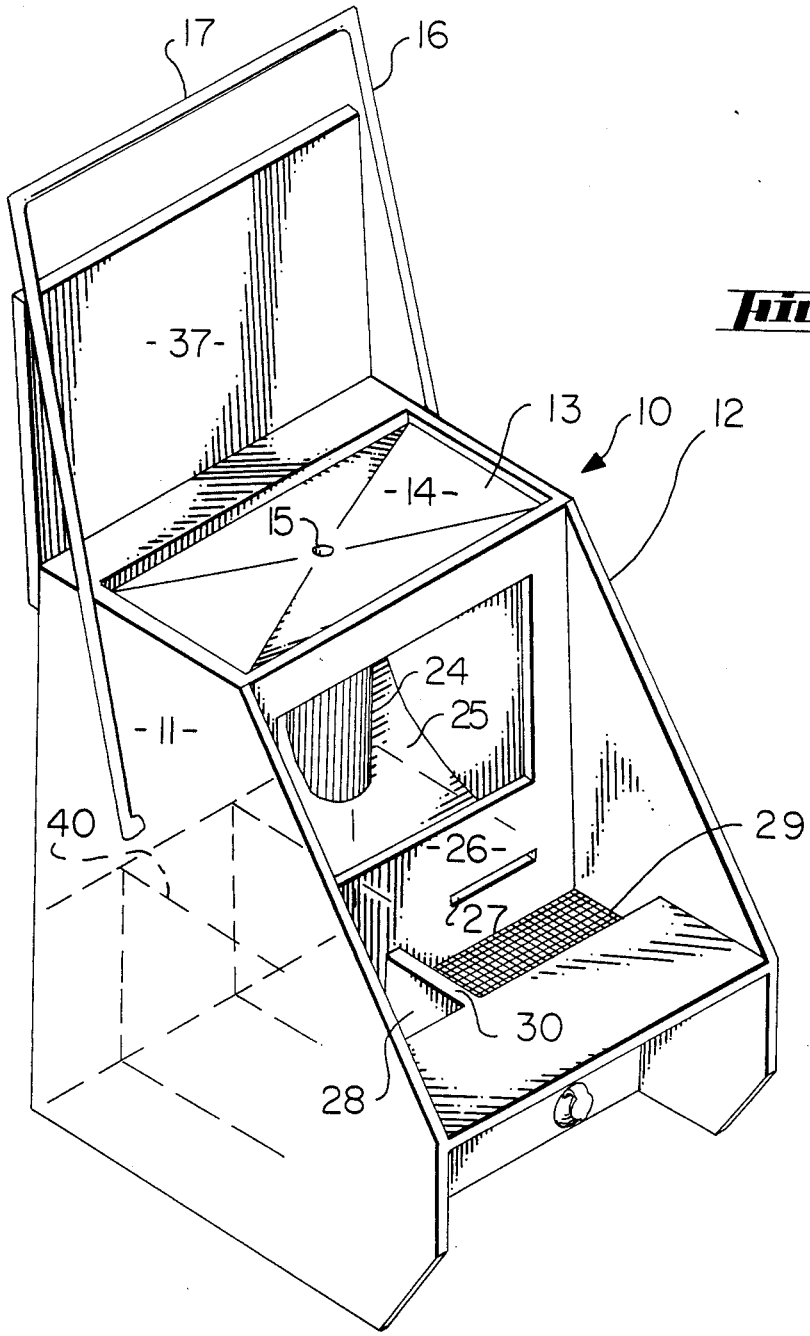
FIG. 1 is a perspective view of the painter's brush box of the present invention.
Figure 1:
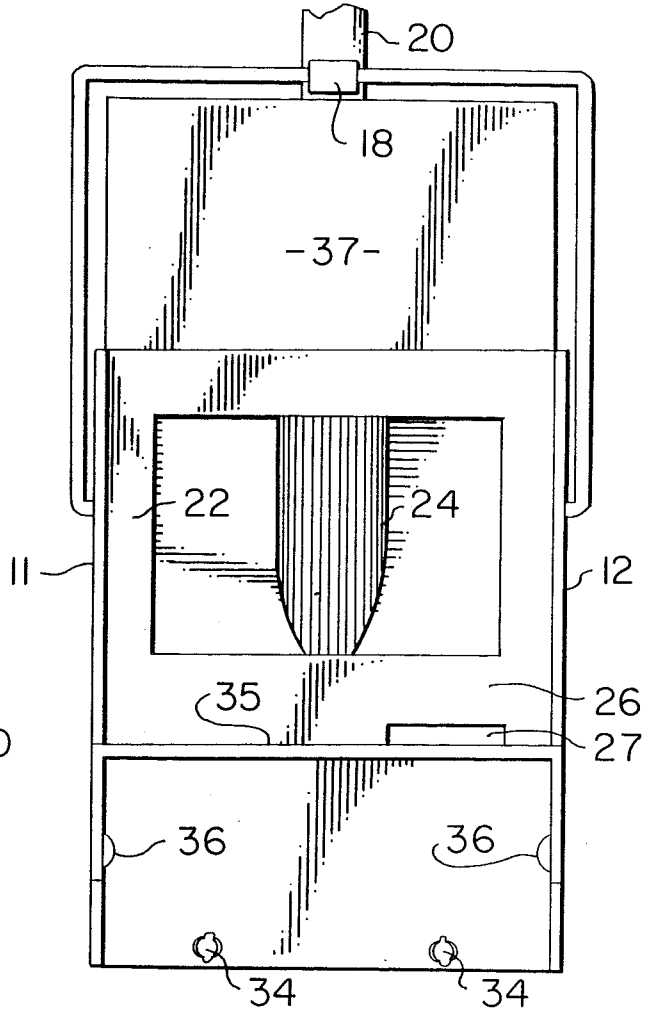
Figure 2:
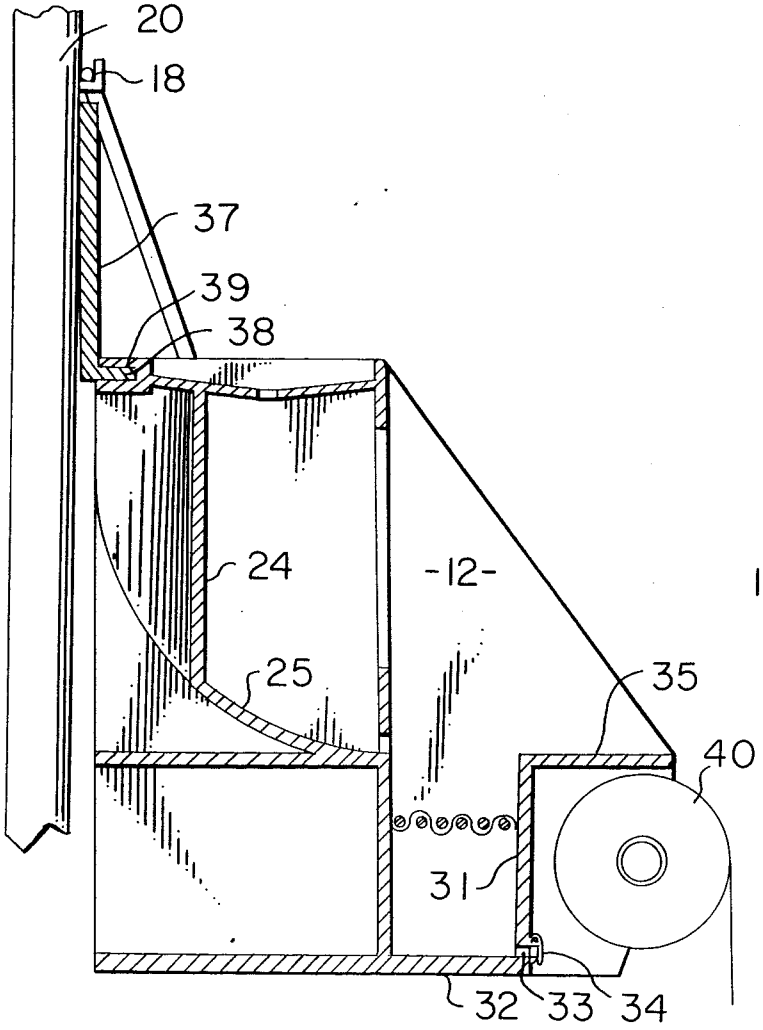
FIG. 2 is a cross-sectional view of the painter's brush box.

The painter's brush box is generally shown by reference numeral 10. The box is generally open in the front and has a removable cover in the back. It has a first left side wall 11 and a right side wall 12. The walls are surmounted by a roof 13 which has a depression 14 or trough culminated in a hole 15 whereby an artist may press a wet solvent containing brush against the depression and any liquid which is expressed from the brush flows downwardly through hole 15.

The side walls are fitted with a rectangular bail handle 16 which is of sufficient length so that the top portion 17 fits onto hook 18 suitably affixed to wall 20 thereby retaining the painter's brush box in an elevated position with no other support. The hook 18 and wall 20 are not part of the present invention.

The side walls 11 and 12 are sloped and open from the front and borded with a frame 22. Vertically and centrally is a rounded splatter block 24. The bottom and backside of the box is fitted with a downwardly sloping floor and backwall 25. The front of the sloping floor 25 terminates in a vertical wall 26 which extends for a short distance above the sloping floor 25. A slit 27 communicates through the vertical wall 26 provides an opening for escaping liquid that may accumulate behind the wall. In use an artist after expressing any solvent from the brush by pressing the brush against the aforesaid depression then slaps the brush several times against the aforementioned splatter block 24 in a horizontal back and forth manner to free any residual solvent from the brush. The splatter of such freed droplets impinge on the vertical block, on the sloping floor and on the inside facing side walls 11 and 12. It will be appreciated that it is common practice to slap a solvent wetted brush against a hard edge. In the instant device the resulting splatter is safely contained.

In front of the vertical wall 26 is a small well 28 and a large well 29 separated by a vertical wall 30. Well 29 is supplied with a screen 30 against which excess solvent may be expressed. The wells are further defined by vertical wall 31 positioned in a spaced relationship with the vertical wall 30. The wells are further defined by bottom 32. The smaller well 28 is further defined by a portion of left side wall 11 and larger well 29 is further defined by a portion of side wall 12. Each of the wells have a bore 33 which are opened or closed by valves 34. The wells are appropriately filled with suitable cleaners and/or solvents. The liquids when spent may be drained from the wells by opening the valves 34 in a sequence as desired. The to-be-cleared brushes may be swirled in the liquids to effect a cleaning thereof.

The vertical wall 31 has extending therefrom a horizontally disposed surface 35 which has utility as a table and covers a roll of paper towels 40 which is suitably journaled at 36 between the inside portions of left side wall 11 and right side wall 12.

It will be appreciated that the entire unit is compact. Compartmented space is provided in the back for brushes; paint tubes and the like Solvents and cleaning liquids cannot be tipped over. The splatter means is well positioned for easy access and use.

The material of construction may be of any of self-sustaining materials, e.g. plastic, wood, rigid paper and the like. As a matter of fact the box shown in the figure is constructed of a transparent plastic material.

The back is closed with an L-shaped member 37 which is one position as shown in the figure can be used as an easel as it extends above the box. In the other position it is turned upside down and extends downwardly to close the back. In each instance the flange 38 fits into horizontal channel 39 at the top of the box.

When the member 37 is in the position shown access can be obtained to the compartments 40 shown by phantom lines.

What is claimed is:

1. A multi compartmented splatter box comprising a box, said box being defined by side walls, a roof, a bottom and a back wall which slopes downwardly, the roof has a depression terminating at its lowest point in an opening therethrough, the sloping wall has a vertical upstanding rounded means extending from the sloping wall upwardly to the roof, at least two wells capable of containing a liquid disposed in front of the sloping wall, the box is open from the one side facing the sloping wall whereby a brush may be dipped selectively into the wells when containing a liquid and the brush may be then struck against the upstanding rounded means to thereby knock off unwanted liquid.

2. The box of claim 1 wherein the box has a horizontally surface extending from said wells and paper towel retaining means is located thereinunder.

3. The box of claim 2 wherein said box is open in the back and a removable cover is provided.

4. The box of claim 3 wherein the cover has a flange along one edge, said box as a horizontal channel at the roof portion, said flange said channel adapted and constructed to mate whereby said cover encloses the back of the box when in one position and extends upwardly above the box when in another position.

5. The box of claim 2 wherein the said wells are provided with valved openings whereby liquid may be selectively drained therefrom.

6. The box of claim 5 wherein means is provided for draining any accumulated knocked off liquid onto the sloping wall into at least one of the wells.

7. The box of claim 6 wherein the box has a bail handle secured to the side walls whereby the box may be easily transported by carrying or may be mounted thereby onto a hook secured to an upright.

* * * * *